US007555241B2

(12) United States Patent
Shishido et al.

(10) Patent No.: US 7,555,241 B2
(45) Date of Patent: Jun. 30, 2009

(54) IMAGE FORMING DEVICE USING A SINGLE-LAYER-TYPE ELECTROPHOTOGRAPHIC PHOTOCONDUCTOR AND IMAGE FORMING METHOD USING THE SAME

(75) Inventors: Makoto Shishido, Osaka (JP); Shiho Okawa, Osaka (JP); Eiichi Miyamoto, Osaka (JP); Yasufumi Mizuta, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 437 days.

(21) Appl. No.: 11/503,812

(22) Filed: Aug. 14, 2006

(65) Prior Publication Data

US 2007/0077089 A1 Apr. 5, 2007

(30) Foreign Application Priority Data

Sep. 30, 2005 (JP) ..... 2005-285869

(51) Int. Cl.
*G03G 15/00* (2006.01)
*G03G 21/00* (2006.01)

(52) U.S. Cl. ..... 399/128; 399/159

(58) Field of Classification Search ..... 399/127–129, 399/159

See application file for complete search history.

(56) References Cited

U.S. PATENT DOCUMENTS 4,757,345 A * 7/1988 Ohashi et al. ..... 399/128
5,729,799 A * 3/1998 Numao et al. ..... 399/128
7,395,011 B2 * 7/2008 Tanaka ..... 399/128

FOREIGN PATENT DOCUMENTS

JP 06-83249 A 3/1994
JP 10-115967 5/1998

* cited by examiner

*Primary Examiner*—William J Royer
(74) *Attorney, Agent, or Firm*—Carmody & Torrance LLP

(57) ABSTRACT

An image forming apparatus which can exhibit an excellent charge eliminating effect by erasing a transfer memory using a precharging device with optimized conditions even when a positively-charged single-layer-type electrophotographic photoconductor is used as a photoconductor. In the image forming apparatus which sequentially arranges a charging device, a developing device, a transfer device, and a charge eliminating device around a single-layer-type electrophotographic photoconductor, the charging device charges a surface of the single-layer-type electrophotographic photoconductor with a positive polarity, a precharging device having a conductive member is arranged on an upstream side of the charge eliminating device, the conductive member is brought into contact with the electrophotographic photoconductor, and a current density $I_b$ ($\mu A/m^2$) of the injected current into the photoconductor from the conductive member is set to a value of 700 ($\mu A/m^2$) or more.

9 Claims, 6 Drawing Sheets

PRIOR ART

IMAGE FORMING DEVICE USING A SINGLE-LAYER-TYPE ELECTROPHOTOGRAPHIC PHOTOCONDUCTOR AND IMAGE FORMING METHOD USING THE SAME

BACK GROUND OF THE INVENTION

1. Field of the Invention

The present invention relates to an image forming apparatus which uses a single-layer-type electrophotographic photoconductor and an image forming method which uses the image forming apparatus, and more particularly to an image forming apparatus which exhibits an excellent effect for eliminating the charge from a surface of the photoconductor even when a positively-charged single-layer-type electrophotographic photoconductor is used.

2. Description of the Related Art

Conventionally, an image forming apparatus which is used for a printer, a copying machine or the like adopts an image forming process which sequentially arranges, around an electrophotographic photoconductor, a charging means which charges the electrophotographic photoconductor, an exposing means which exposes a surface of the charged photoconductor thus forming a latent image, a developing means which transfers a toner to the latent image for developing, a transfer means which transfers the toner to a recording paper and visualizes an image, and a charge eliminating means which erases a residual potential which remains on a surface of the photoconductor after transferring the toner to the recording paper.

Further, in such an image forming process, there has been adopted a reversal developing method which transfers the toner image by applying a voltage having a polarity opposite to a charged polarity of a surface of the photoconductor at the time of transferring a toner image on the recording paper.

In using such reversal developing method, there may be a case in which a so-called transfer memory occurs, that is, a potential of a polarity opposite to the charged polarity remains on the surface of the photoconductor after transferring the toner to the recording paper.

This transfer memory may be erased by a charge eliminating means used in a succeeding stage. However, when the image forming apparatus is used repeatedly, a slight transfer memory which cannot be eliminated by the charge eliminating means is stored in the inside of the photoconductor thus giving rise to a drawback that the image property is deteriorated.

Further, when a contact-charge-type charging means is adopted as the charging means, the contact-charge-type charging means has the simple constitution as a whole compared to a non-contact-charge-type charging means and generates no harmful substances such as ozone and hence, the contact-charge-type charging means exhibits the excellent environmental property. However, the charging means cannot obtain a sufficient charge saturation region and hence, the charging means has a drawback that it is difficult to apply the charging means to the single-layer-type electrophotographic photoconductor which exhibits the excellent productivity.

Accordingly, to overcome such a drawback, as shown in FIG. 6, there has been proposed an image forming apparatus which adopts a reversal developing method. In the image forming apparatus 100 which includes a contact-type primary charging roller 102, a developing means 104, a transfer means 106 and a pre-exposure lamp 109, by providing a contact-type pre-charging roller 108 which is charged with a polarity equal to a polarity of the contact-type primary charging roller 102 on an upstream side of the contact-type primary charging roller 102, a surface of a photoconductor 101 which is charged with a polarity opposite to the polarity of the contact-type primary charging roller 102 is charged up to the same polarity as the contact-type primary charging roller 102 by the contact-type precharging roller 108 thus erasing a transfer memory (see for Patent document 1).

[Patent document 1] JP6-83249A (Claims, FIG. 1)

DISCLOSURE OF THE INVENTION

Problems to be Solved by the Invention

However, in such an image forming apparatus, the charging conditions of a precharging roller is not sufficiently taken into consideration and, for example, when shapes or materials of a charging roller is changed, a quantity of the injected current into the surface of the photoconductor from the charging roller becomes insufficient, thus giving rise to a drawback that transfer memory cannot be sufficiently erased.

Further, depending on a voltage applying condition in a transfer means, a transfer memory potential is elevated and hence, even after a toner image passes a position of the precharging roller, the transfer memory is not sufficiently erased and remains on the surface of the photoconductor thus deteriorating the image property.

Further, the charging roller used here is of a negative charging type to which a voltage of negative polarity is applied. Accordingly, when a positive-charge-type charging roller which is liable to bring about the easier retention of the charge in the inside of the photoconductor is applied to the image forming apparatus, there may be a case that the image forming apparatus cannot sufficiently erase the transfer memory.

Accordingly, inventors of the present invention have extensively studied and, as the result of the study, have found out that by using an image forming apparatus which provides a precharging means for erasing a transfer memory on an upstream side of a charge eliminating means and, at the same time, by defining a current density of an injected current into a photoconductor from the precharging means within a predetermined range, the transfer memory may be sufficiently erased and the generation of charge irregularities may be suppressed. The present invention has been accomplished based on such finding.

That is, it is an object of the present invention to provide an image forming apparatus and an image forming method which uses the image forming apparatus which can exhibit an excellent charge eliminating effect by erasing a transfer memory using a precharging means with optimized conditions even when a positively-charged single-layer-type electrophotographic photoconductor is used as a photoconductor.

Means for Solving the Problem

According to the present invention, in an image forming apparatus which sequentially arranges a charging means, a developing means, a transfer means, and a charge eliminating means around a single-layer-type electrophotographic photoconductor, the charging means is formed of a charging means which charges a surface of the single-layer-type electrophotographic photoconductor with a positive polarity, a precharging means having a conductive member is arranged on an upstream side of the charge eliminating means, the conductive member is brought into contact with the surface of the single-layer-type electrophotographic photoconductor, and a current density $I_b$ ($\mu A/m^2$) of an injected current into the photoconductor from the conductive member is set to a value of 700 ($\mu A/m^2$) or more, thus overcoming the above-mentioned drawbacks.

That is, according to the image forming apparatus of the present invention, in the image forming apparatus which adopts the positively charged single-layer-type electrophotographic photoconductor, by using the precharging means for erasing the transfer memory under the predetermined conditions, a generated transfer memory may be erased thus allowing the image forming apparatus to exhibit an excellent charge eliminating effect.

Further, in constituting the present invention, assuming the current density of the current which is supplied from the conductive member as $I_b$ ($\mu A/m^2$) and a current density of the injected current into the photoconductor from the transfer means as $I_t$ ($\mu A/m^2$), it may be preferable to set a value expressed by $|I_b/I_t|$ to 2 or more.

Due to such a constitution, it may be possible to define a voltage applying condition in the precharging means such that the voltage applying condition corresponds to a residual potential of the transfer memory and hence, the precharging means may be operated under a further optimum condition.

Further, in constituting the present invention, assuming an absolute value of the current density $I_t$ ($\mu A/m^2$) of the injected current into the photoconductor from the transfer means as a value of 316 or more, it may be preferable to set an absolute value of the transfer memory potential (V) to 8.

Due to such a constitution, it is possible to determine the current injecting condition in the transfer means corresponding to a value of the transfer memory and hence, the condition in the transfer means may be easily optimized.

Further, in constituting the present invention, it is preferable to set an applied voltage which is applied to the conductive member to a value of 1100 (V) or more in a DC voltage.

Due to such a constitution, irrespective of a resistance value of the conductive member, a surface potential of an electrophotographic photoconductor after passing the precharging means may be lowered thus allowing the image forming apparatus to exhibit an excellent charge eliminating effect.

Further, in constituting the present invention, it may be preferable that the conductive member may be formed of a brush-like conductive member.

Due to such a constitution, it may be possible to allow the conductive member to effectively perform the triboelectrification while suppressing the generation of wear of the surface of the photoconductor.

Further, in constituting the present invention, it may be preferable to set the yarn resistance of a brush which constitutes the conductive member to a value of $1\times10^{10}$ ($\Omega\cdot$cm) (=10(log $\Omega\cdot$cm)) or less.

Due to such a constitution, it may be possible to suppress a charged voltage applied to the conductive brush within a predetermined range thus preventing the abnormal discharge in the vicinity of a contact portion between the conductive brush and the surface of the photoconductor.

Further, in constituting the present invention, it may be preferable that the charging means may be formed of a contact-charge-type charging means.

Due to such a constitution, it is possible to provide an image forming apparatus which has the more simplified constitution and, at the same time, exhibits the excellent environmental property.

Further, in constituting the present invention, it may be preferable to set an initial charge potential of a single-layer-type electrophotographic photoconductor by the charging means to a value of 400(V) or more.

Due to such a constitution, the image forming apparatus may exhibit the excellent charge eliminating effect by allowing the precharging means to erase the transfer memory while maintaining the desired image property.

According to another aspect of the present invention, in an image forming method which uses an image forming apparatus which sequentially arranges a charging means, a developing means, a transfer means, and a charge eliminating means around a single-layer-type electrophotographic photoconductor, the single-layer-type electrophotographic photoconductor is charged with a positive polarity by the charging means, a precharging means having the conductive member is arranged on an upstream side of the charge eliminating means, a conductive member is brought into contact with the surface of the single-layer-type electrophotographic photoconductor, and a current density $I_b$ ($\mu A/m^2$) of an injected current into the photoconductor from the conductive member is set to a value of 700 ($\mu A/m^2$) or more.

DESCRIPTION OF THE PREFERRED EMBODIMENTS

First Embodiment

Hereinafter, the first embodiment on an image forming apparatus according to the present invention will be specifically explained in conjunction with drawings when necessary.

1. Image Forming Apparatus (1) Basic Constitution

Figure 1:
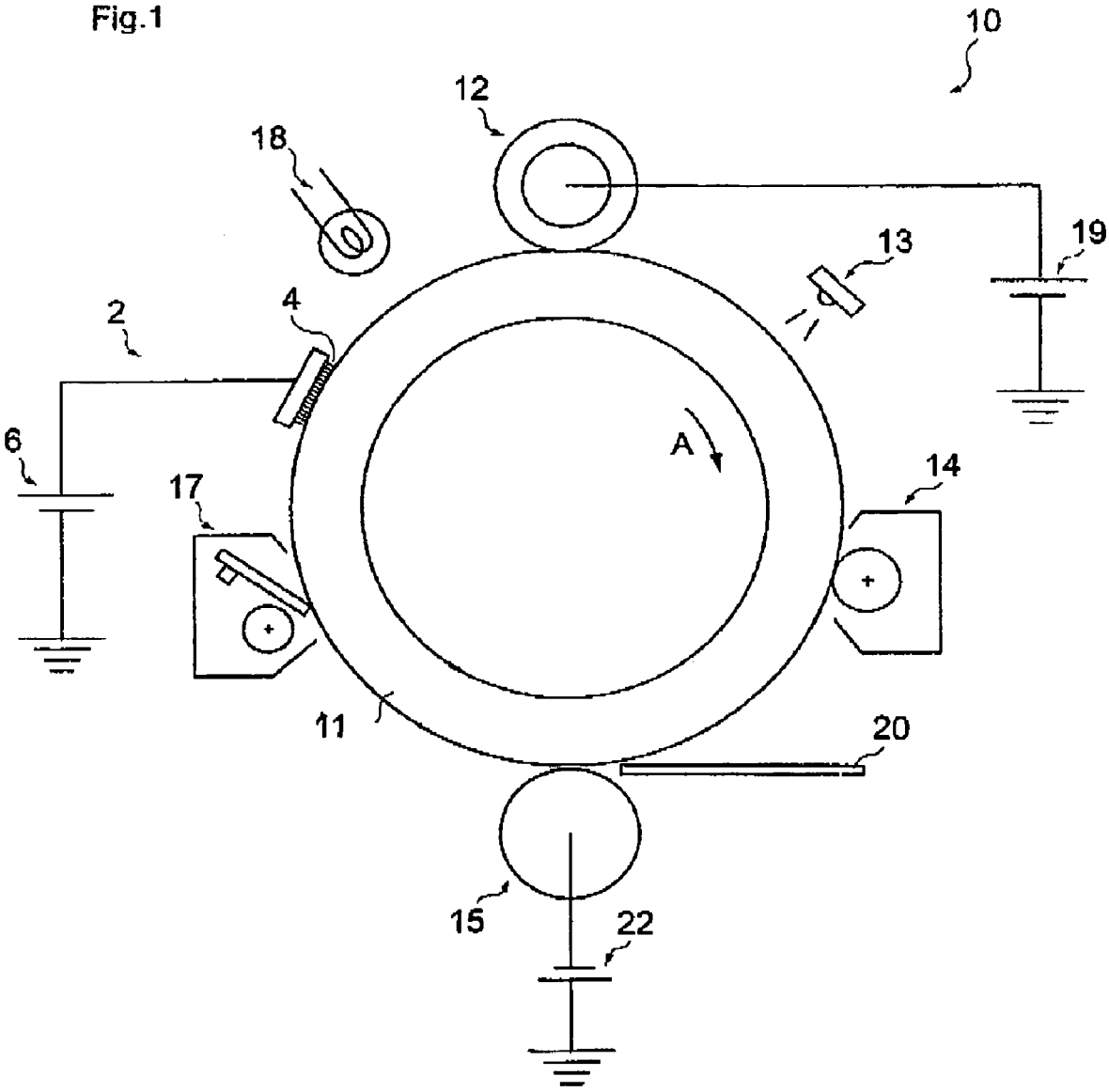
FIG. 1 is a schematic view of an image forming apparatus according to the present invention.

FIG. 1 shows the basic constitution of an image forming apparatus 10 according to the present invention. The image forming apparatus 10 includes a drum-type single-layer-type electrophotographic photoconductor (hereinafter, also referred to as a photoconductor) 11. Around the photoconductor 11, along the rotational direction indicated by an arrow A, a charging means 12, an exposing means 13 for forming a latent image on a surface of the photoconductor 11, a developing means 14 for developing a latent image by allowing a toner to adhere to the surface of the photoconductor 11, a transfer means 15 for transferring the toner to a recording paper 20, a cleaning device 17 for removing residual toner on the surface of the photoconductor 11, a precharging means 2 for erasing a transfer memory generated by the transfer means 15, and a charge eliminating means 18 for eliminating a residual potential on the surface of the photoconductor 11 are arranged in order.

Further, to the charging means 12, a power source 19 for applying a charge applied voltage is connected. The power source 19 may apply only a DC component (DC) or may apply a superposed voltage which is formed by superposing an AC component (AC) to the DC component. Here, by connecting the power source 19 to the charging means 12 in a manner that the charging means 12 is a positive polarity, the image forming apparatus 10 may be formed into a positive-polarity-type image forming apparatus.

Further, a power source 22 is connected to the transfer means 15. The power source 22 is a power source which can apply a DC component (DC) and the power source 22 is connected to the transfer means 15 such that a transfer-means side of the power source 22 assumes a negative polarity. By connecting the power source 22 in this manner, it may be possible to form the image forming apparatus 10 into a reversal-developing-type image forming apparatus.

Further, when the reversal developing method is adopted, a surface of the photoconductor 11 charged with a positive polarity is reversely charged so that a transfer memory having a negative potential is generated on the surface thereof. The transfer memory is erased by the charge eliminating means 18 afterward. However, when the transfer memory is not sufficiently erased by the charge eliminating means 18, the uniformity of charge by the charging means 12 is influenced and charge irregularities are generated thus becoming a factor of lowering an image property.

(2) Precharging Means (2)-1 Basic Constitution

Next, the precharging means 2 which constitutes means for erasing the transfer memory will be explained. As shown in FIG. 1, the precharging means 2 is constituted of a conductive member 4 which is directly brought into contact with the surface of the photoconductor 11, and a power source 6 which applies a predetermined voltage to the conductive member 4. Here, the power source 6 is connected to the conductive member 4 in a manner that a conductive-member-4 has a positive polarity. That is, a polarity opposite to the polarity of the transfer means 15 is applied to the power source 6.

Further, the power source 6 may apply only the DC component (DC) in conformity with the mode of the precharging means 2. Further, the power source 6 may apply a superposed voltage which overlaps an AC component to the DC component for obtaining the stable charging property by widening a charge saturation range.

(2)-2 Conductive Member

Further, although the conductive member 4 is not limited provided that the conductive member 4 has the conductivity and can charge the surface of the photoconductor 11, the conductive member 4 may preferably be a conductive brush which is a brush-like conductive member.

The reason is that such a conductive brush can easily generate the triboelectrification with the surface of the photoconductor while preventing the generation of wear on the surface of the photoconductor.

Further, a material of the conductive brush may preferably be a relatively soft fiber material such as a polyamide resin or a polyester resin into which conductive particles made of carbon or the like are impregnated.

The reason is that it is possible to adjust the conductive property of the conductive brush by adjusting an addition quantity of the conductive particles to the conductive brush and, at the same time, the generation of wear of the surface of the photoconductor may be also reduced thus prolonging a lifetime of the conductive brush.

Further, the conductive brush may be formed into, for example, a rod-like shape or a cylindrical shape having a rotary mechanism. Still further, the conductive brush may be formed into a curved shape which is deformed to follow a curvature of the surface of the photoconductor. The shape of the conductive brush may be suitably selected from these shapes corresponding to the desired charging property.

Further, the conductive member may preferably be of a movable type. This is because that by allowing the conductive member to move in the radial direction of the electrophotographic photoconductor, for example, it is possible to adjust a pressing force of the conductive member to the surface of the photoconductor and hence, the charging property may be easily controlled.

Here, the pressing force of the conductive member against the surface of the photoconductor may preferably be set to a value within a range from 0.1 to 100 (kgf/cm$^2$).

Further, the conductive member may preferably be of a detachable type. This is because the exchange of the conductive member is facilitated. Further, when it is necessary to change the specification of the image forming apparatus to the constitution which generates the relatively small transfer memory such as when the applied voltage used in the transfer means is small or when a stacked photoconductor is used as the photoconductor or the like, such an exchangeable conductive member can easily cope with the change of the specification.

(2)-3 Charging Property

Further, in the precharging means 2, by applying a predetermined voltage to the conductive member 4 by using the power source 6, the transfer memory which is generated by the transfer means 15 may be erased.

Here, with respect to the voltage applying condition which is applicable to the precharging means 2, the current density ($I_b$) of the current which flows into the photoconductor 11 from the conductive member 4 may be set to a value of 700 (μA/m$^2$) or more.

Figure 2:
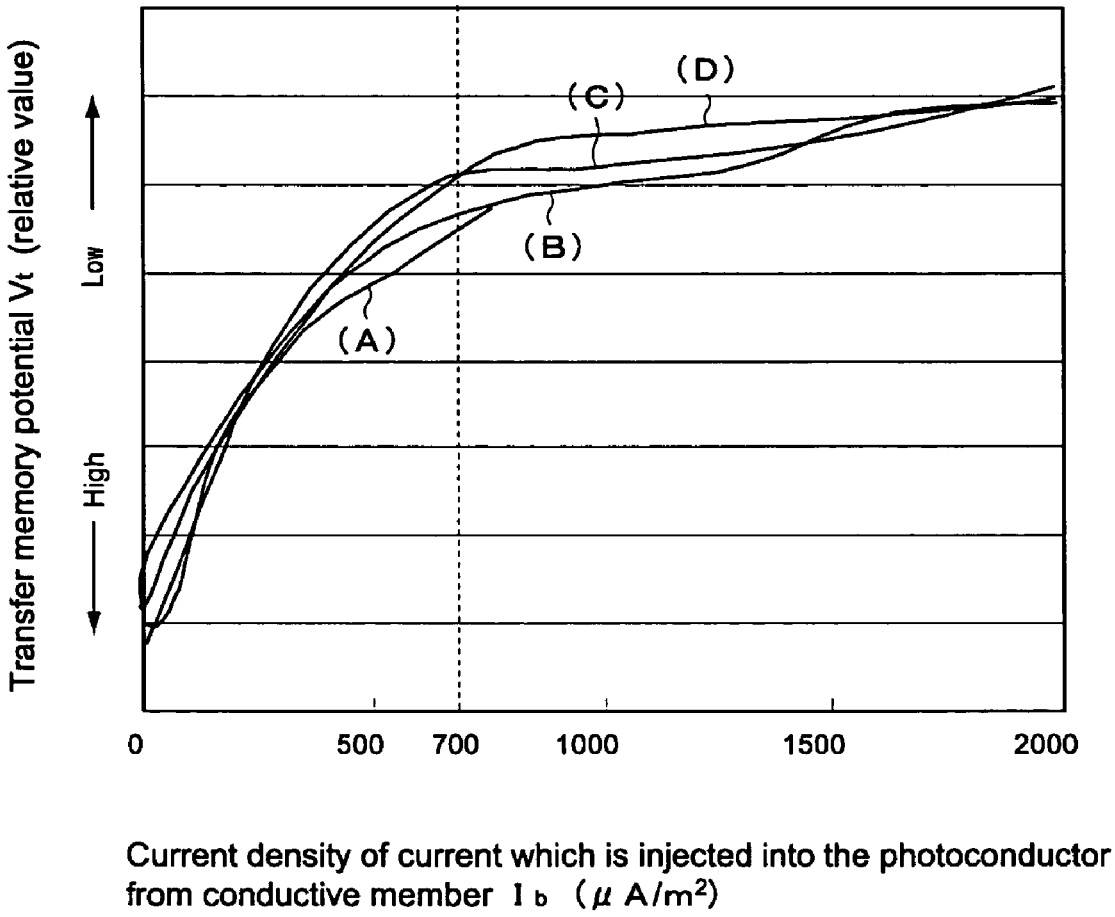
FIG. 2 is a characteristic graph showing the relationship between a current density ($I_b$) of an injected current into a surface of a photoconductor from a conductive member and a transfer memory potential ($V_t$)

Here, FIG. 2 is a characteristic graph showing the relationship between the current density ($I_b$) of the current which is injected into the photoconductor from the conductive member and the transfer memory potential ($V_t$) when a positively charged single-layer-type electrophotographic photoconductor is used as the photoconductor.

In FIG. 2, the current density ($I_b$) of the current which is injected into the photoconductor from the conductive member is taken on an axis of abscissas and the transfer memory potential ($V_t$) is taken on an axis of ordinates.

That is, FIG. 2 shows that as the transfer memory potential ($V_t$) is increased along the axis of ordinates, an erasing quantity of the transfer memory by the precharging means is increased, while the transfer memory potential ($V_t$) is decreased along the axis of ordinates, the erasing quantity of the transfer memory by the precharging means is decreased.

Further, curves (A) to (D) shown in FIG. 2 are characteristic curves when respective conductive brushes having different yarn resistances are used as the conductive member. To be more specific, the curves (A) to (D) in FIG. 2 indicate curves when the conductive brushes having the yarn resistances of $1\times10^{12.5}$ (Ω·cm), $1\times10^{10.5}$ (Ω·cm), $1\times10^{6.5}$ (Ω·cm) and $1\times10^{6.5}$ (Ω·cm) respectively in order are used.

Further, in the present invention, the transfer memory potential ($V_t$) is defined as a change quantity of a surface potential of the surface of the photoconductor at the developing position when the continuous printing is carried out.

To be more specific, the transfer memory potential ($V_t$) is defined as a value which is expressed as ($V_1$)−($V_3$) assuming the surface potential of the surface of the photoconductor in the developing position at the first turn as ($V_1$) and the surface potential of the surface of the photoconductor in the developing position at the third turn as ($V_3$) when a white paper image is printed by continuously rotating the photoconductor.

As can be understood from FIG. 2, irrespective of the value of the yarn resistance of the conductive brush, the higher the current density ($I_b$), the residual transfer memory potential is decreased. Particularly, it is possible to say that the residual transfer memory potential is stably erased, when the current density ($I_b$) assumes a value of 700 ($\mu A/m^2$) or more.

To the contrary, when the current density ($I_b$) is excessively elevated, there exists a possibility that the abnormal discharging occurs in the vicinity of a contact portion between the conductive brush and the surface of the photoconductor thus giving rise to undesired charging property.

Accordingly, a range of such current density ($I_b$) may preferably be set to a value within a range from 700 to 2000 ($\mu A/m^2$) and may more preferably be set to a value within a range from 1000 to 1500 ($\mu A/m^2$).

Further, in the present invention, the current density implies a value which is obtained by dividing the current value with the area per 1 second. That is, when the current having the current value I (A) flows into the rotating photoconductor having an axial length L (mm) at a circumferential speed D (mm/sec), the current density may be expressed by $I/(L\times D)$ ($\mu A/m^2$).

Figure 3:
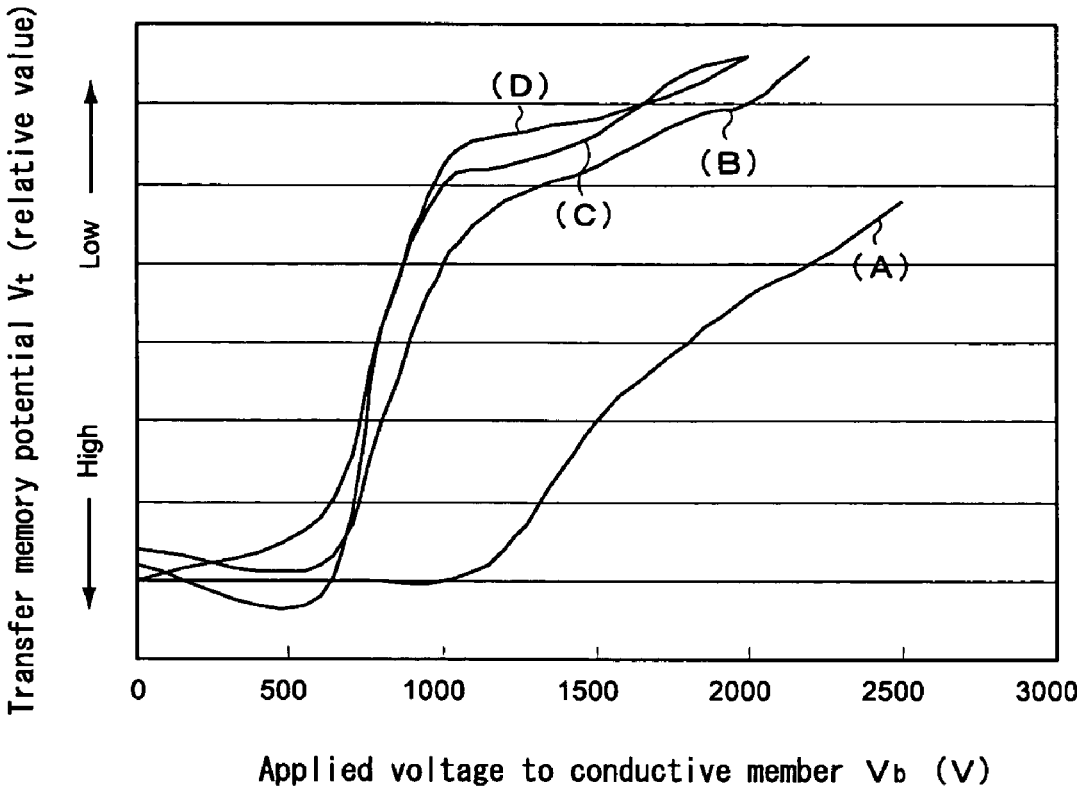
FIG. 3 is a characteristic graph showing the relationship between an applied voltage ($V_b$) which is applied to the conductive member and the transfer memory potential (V)

Further, FIG. 3 is a characteristic graph expressing the relationship between the applied voltage ($V_b$) to the conductive member and the transfer memory potential ($V_t$).

In this characteristic graph, the applied voltage ($V_b$) to the conductive member is taken on an axis of abscissas, and the transfer memory potential ($V_t$) is taken on an axis of ordinates.

That is, FIG. 3 is a graph in which the current density ($I_b$) in FIG. 2 is converted into a voltage by using values of yarn resistances of respective characteristic curves (A) to (D). As can be understood from FIG. 3, the higher the value of yarn resistance of the conductive brush, it is necessary to apply the higher voltage to erase the transfer memory. It is understood particularly that in comparing the transfer memory potentials at the same applied voltage, when the yarn resistance of the conductive brush exceeds $1\times10^{11}$ ($\Omega\cdot$cm), the erasing of the transfer memory potential becomes remarkably insufficient.

Accordingly, the yarn resistance of the conductive brush may preferably be set to a value of $1\times10^{11}$ ($\Omega\cdot$cm) or less. On the other hand, when the yarn resistance of the conductive brush is excessively lowered, there may be a case that the triboelectrification is not sufficiently performed and hence, the transfer memory is not sufficiently erased.

Accordingly, as a range of the value of the yarn resistance, the value of the yarn resistance may preferably be set to a value within a range from $1\times10^{3}$ to $1\times10^{10}$ ($\Omega\cdot$cm), and may more preferably be set to a value within a range from $1\times10^{5}$ to $1\times10^{9}$ ($\cap\cdot$cm).

Further, the applied voltage ($V_b$) to the conductive member may preferably be set to a value of 1100 (V) or more in a DC voltage. It is because that as shown in FIG. 3, irrespective of an intrinsic resistance value of the conductive member, it is possible to lower the transfer memory potential ($V_t$).

On the other hand, when the applied voltage ($V_b$) is excessively elevated, there may be a case that the abnormal discharge occurs between the conductive brush and the photoconductor thus adversely influencing the charging property.

Accordingly, the applied voltage ($V_b$) may preferably be set to a value within a range from 1100 to 3000 (V), and may more preferably be set to a value within a range from 1100 to 2000 (V).

Further, assuming the current density of the current which is injected into the photoconductor from the conductive member as $I_b$ ($\mu A/m^2$) and the current density of the current which is injected into the photoconductor from the transfer means as $I_t$($\mu A/m^2$), it may be preferable to set a value which is expressed by $|I_b/I_t|$ to 2 or more.

Figure 4:
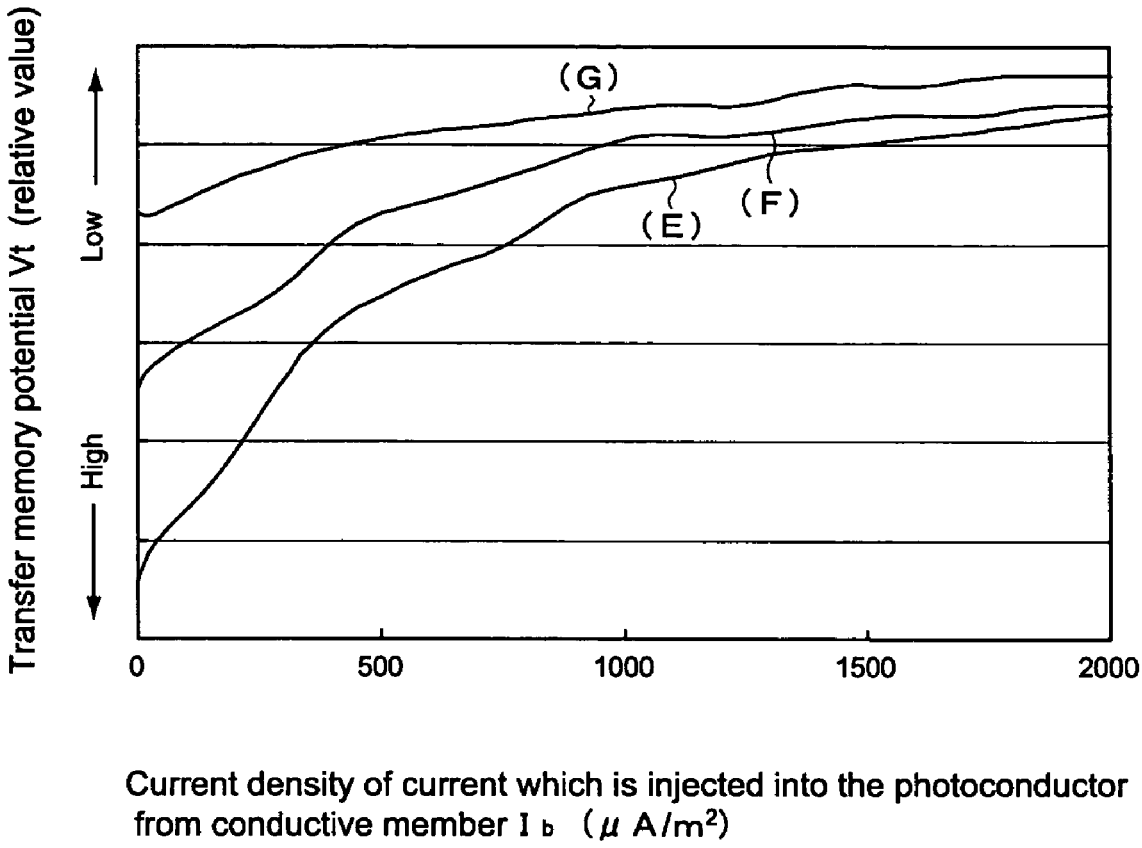
FIG. 4 is a characteristic graph showing the relationship between a current density ($I_t$) of a current which flows into the surface of the photoconductor from a transfer means and the transfer memory potential ($V_t$)

Here, FIG. 4 is a characteristic graph which expresses the relationship between the current density ($I_b$) of the current which is injected into the photoconductor from the conductive member and the transfer memory potential ($V_t$) when the conductive brush having the predetermined yarn resistance is used as the conductive member for every current density ($I_t$) of the current which is injected into the photoconductor from the transfer means. Further, curves (E) to (G) in FIG. 4 indicate characteristic curves when the current density ($I_t$) of the current which is injected into the photoconductor from the transfer means sequentially assumes −395 ($\mu A/m^2$), −316 ($\mu A/m^2$), and −237 ($\mu A/m^2$).

Figure 5:
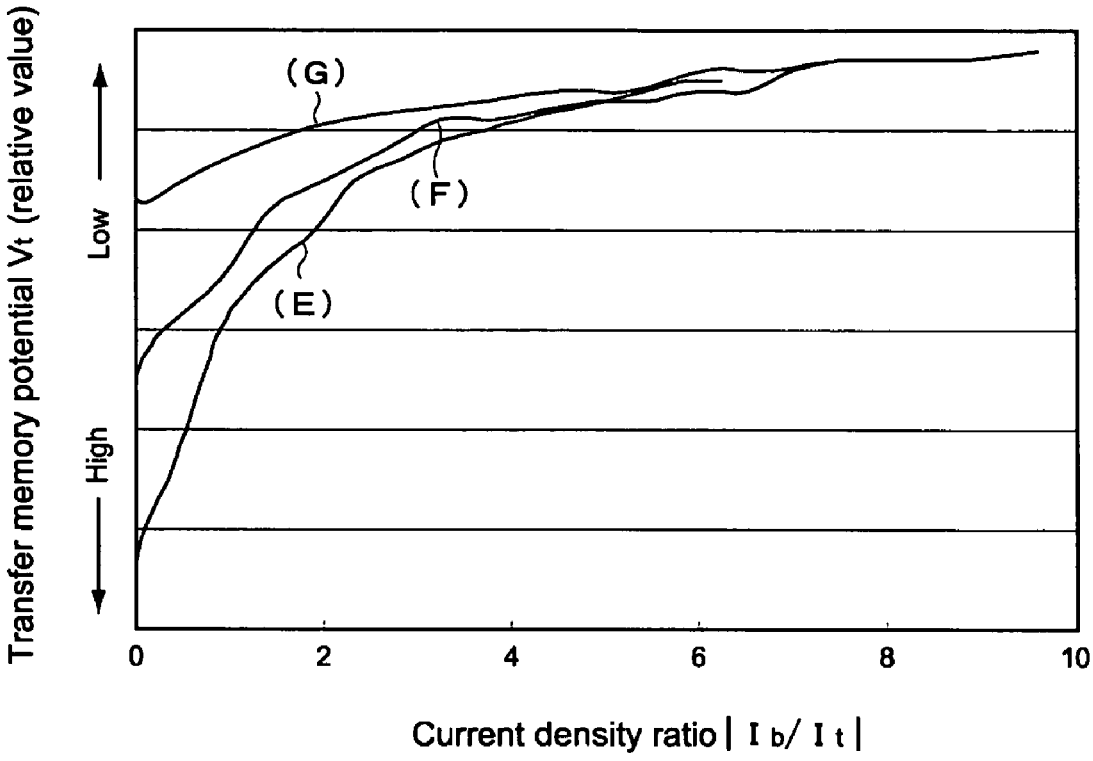
FIG. 5 is a characteristic graph showing the relationship between a ratio $|I_b/I_t|$ of the current density and the transfer memory potential ($V_t$)
Figure 6:
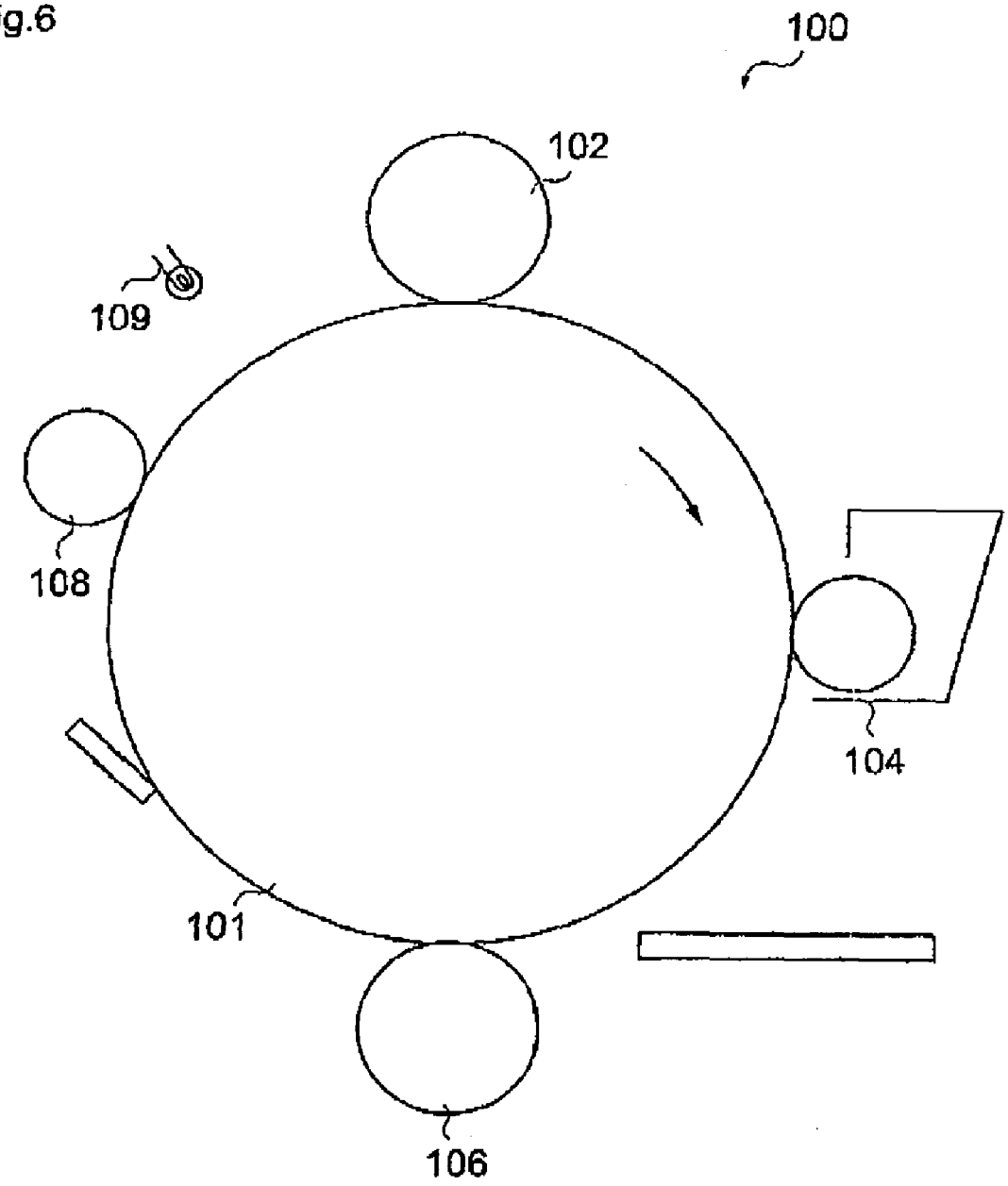
FIG. 6 is a view which serves to explain the constitution of a conventional image forming apparatus.

Further, FIG. 5 is a characteristic graph in which the axis of abscissas in FIG. 4 is converted into $|I_b/I_t|$.

As can be understood from these characteristic graphs, the larger the absolute value of the current density ($I_t$) of the current which is injected into the photoconductor from the transfer means, the transfer memory potential ($V_t$) is increased. To be more specific, it is understood that when the value expressed by $|I_b/I_t|$ is set to 2 or more, the transfer memory potential ($V_t$) is sufficiently lowered.

That is, in the characteristic curve (E), when the absolute value of the current density ($I_b$) of the current which is injected into the photoconductor from the conductive member is set to a value of 790 or more, the transfer memory potential is lowered. Further, it is understood that when the absolute value of the current density ($I_b$) in the characteristic curve (F) is set to a value of 632 or more, or when the absolute value of the current density ($I_b$) in the characteristic curve (G) is set to a value of 474 or more, the respective transfer memories are sufficiently erased.

To the contrary, when the current density ($I_b$) is excessively elevated, there may be a case that the abnormal discharge occurs in the vicinity of a contact portion between the conductive brush and the surface of the photoconductor thus giving rise to the undesired charging property.

Accordingly, the value which is expressed by $|I_b/I_t|$ may preferably be set to a value within a range from 2.5 to 8.0, and may more preferably be set to a value within a range from 3.0 to 6.0.

(3) Charging Means

Further, in the present invention, the charging means which charges the surface of the photoconductor at the predetermined potential may preferably be constituted of a contact-charge-type charging means.

This is because that compared to a case which adopts a non-contact charge type such as a corona charge as a charging means, the contact-charge-type charging means is miniaturized, does not generate harmful substances such as ozone or the like which is generated at the time of a corona charge, and exhibits the excellent environmental property.

On the other hand, the contact-charge type charging means may be slightly inferior to the non-contact charge-type charging means with respect to some points including the generation of wear of the surface of the photoconductor, or the uniform charging property. However, in the present invention, the precharging means is operated under the predetermined condition and, at the same time, the predetermined conductive member is used as the contact member and hence, it is possible to use the contact-charge-type charging means without deteriorating the image property.

Further, an initial charge potential of the single-layer-type electrophotographic photoconductor by the charging means may preferably be set to a value of 400 (V) or more.

This is because that although the transfer memory potential which is generated in the transfer means is elevated by elevating the initial charge potential to a predetermined value or more, with the use of the image forming apparatus of the present invention which exhibits the excellent charge eliminating effect, the image forming apparatus can obtain a desired image density while suppressing the generation of the image irregularities.

Further, in the charging means, a member which constitutes the contact portion with the surface of the photoconductor may preferably be made of conductive rubber or conductive sponge.

To be more specific, the member which constitutes such a contact portion may be made of polarization rubber (ionic conductive rubber) showing the semiconductor property such as epichlorohydrin rubber, an acrylonitrile butadiene copolymer (NBR) or ion conductive rubber to which the semiconductor property is imparted by adding an ionic conductive agent to urethane rubber, acryl rubber, silicone rubber or the like. Here, a volume intrinsic resistance of the member may preferably be set to a value within a range from $1\times10^3$ to $1\times10^{10}$ ($\Omega\cdot$cm).

Second Embodiment

This embodiment is directed to another aspect of the present invention. That is, in an image forming method which uses an image forming apparatus which sequentially arranges a charging means, a developing means, a transfer means, and a charge eliminating means around a single-layer-type electrophotographic photoconductor, the photoconductor is charged with a positive polarity by the charging means, a precharging means having a conductive member is arranged on an upstream side of the charge eliminating means, the conductive member is brought into contact with the surface of the single-layer-type electrophotographic photoconductor, and a current density $I_b$ ($\mu A/m^2$) of an injected current into a surface of the photoconductor from the conductive member is set to a value of 700 ($\mu A/m^2$) or more.

Hereinafter, the explanation of the contents which have been already explained in conjunction with the first embodiment is omitted and the explanation is made by focusing on points which make the second embodiment different from the first embodiment.

That is, in carrying out the image forming method of the second embodiment, the image forming apparatus 10 shown in FIG. 1 may preferably be used.

Here, FIG. 1 is a schematic view showing the whole constitution of the image forming apparatus, and the manner of operation of the image forming apparatus is explained sequentially.

First of all, the photoconductor 11 of the image forming apparatus 10 is rotated at a predetermined process speed (circumferential speed) in the direction indicated by an arrow A and, thereafter, the surface of the photoconductor 11 is charged to a predetermined potential by the charging means 12.

Next, the surface of the photoconductor 11 is exposed with light from the exposing means 13 in a state that the light is modulated in response to the image information and is radiated to the surface of the photoconductor 11 by way of a reflection mirror and the like. An electrostatic latent image is formed on the surface of the photoconductor 11 by this exposure.

Then, the latent-image developing is performed by using the developing means 14 based on the electrostatic latent image. A toner is stored in the inside of the developing means 14 and the toner is adhered to the surface of the photoconductor 11 corresponding to the electrostatic latent image thus forming a toner image.

Further, a recording paper 20 is conveyed to a lower portion of the photoconductor 11 along a predetermined transfer conveying route. Here, by applying a predetermined transfer bias between the photoconductor 11 and the transfer means 15, the toner image may be transferred to the recording paper 20.

Then, the recording paper 20 to which the toner image is transferred is separated from the surface of the photoconductor 11 by a separating means (not shown in the drawing) and is conveyed to a fixing device by a conveying belt. Subsequently, in the fixing device, the toner image is fixed to the surface of the recording paper 20 by heating and pressurizing treatment and, thereafter, the recording paper 20 is discharged to the outside of the image forming apparatus 10 by a discharging roller.

On the other hand, the photoconductor 11 continues the rotation thereof even after the toner image is transferred, and residual toner (adhesive material) which is not transferred to the recording paper 20 at the time of transferring the toner image is removed from the surface of the photoconductor 11 by the cleaning device 17 of the present invention. Further, the charge which remains on the surface of the photoconductor 11 is erased by the precharging means 2 and, at the same time, the residual charge is completely erased by the radiation of charge elimination light from the charge eliminating means 18, whereby the photoconductor 11 serves to the next image formation.

Here, with the use of the image forming apparatus of the present invention, by defining the current density of the current which flows into the surface of the photoconductor from the precharging means within a predetermined range, the transfer memory may be erased thus exhibiting an excellent charge eliminating effect.

EXAMPLES

Example 1

1. Formation of Electrophotographic Photoconductor 2.7 parts by weight of X-type metal-free phthalocyanine which constitutes a charge generating substance, 50 parts by weight of a stilbene amine compound which constitutes a hole transport agent, 35 parts by weight of an azo quinine compound which constitutes an electron transport agent, and 100 parts by weight of Pan lite TS2050 (made by Teijin Chemical Ltd. average molecular weight: 30000) which is a bisphenol-Z type polycarbonate resin and constitutes a binding resin, and 700 parts by weight of tetrahidrofuran are accommodated into an agitating vessel and, thereafter, these components are mixed and dispersed in a ball mill for 50 hours thus forming a coating liquid. Next, the obtained coating liquid is applied to a conductive support body which is formed of an alumite base tube by a dip coating method. Thereafter, the conductive support body is dried with hot air at a temperature of 130° C. for 45 minutes thus obtaining a single-layer-type electrophotographic photoconductor having a film thickness of 30 μm and a diameter of 30 mm.

2. Formation of Conductive Member

Further, as the conductive member, a conductive nylon brush (single filament fineness: 6.9 T, length: 5 mm, yarn resistance: $1\times10^{8.5}$ (Ω·m)) is used.

3. Evaluation (1) Evaluation of Charge

The obtained photoconductor is mounted on a printer KM1500 remodeled machine made by KYOCERA MITA Corp. and, at the same time, a conductive member is connected and fixed to the photoconductor by compression bonding such that a nip width becomes 5 mm and a bristle top nipping quantity to 0.5 mm.

Next, the photoconductor is rotated at a peripheral speed (circumferential speed) of 110 (mm/sec). Further, a DC voltage of 1200 (V) is applied between the surface of the photoconductor and the conductive member thus charging the surface of the photoconductor to approximately 400 (V).

Next, a DC voltage is applied between the transfer means and the surface of the photoconductor thus adjusting the current density ($I_t$) of the current which is injected into the photoconductor from the transfer means such that the current density ($I_t$) assumes −237 (μA/m$^2$) (converted current value −6 (μA)).

Next, a voltage of 2000(V) is applied to the precharging means and the printing is performed by feeding the recording paper, at the same time, the transfer memory potential is measured and the surface potential is evaluated in accordance with the following criteria. The obtained result is shown in Table 1.

Further, besides setting the current density ($I_t$) to −237 (μA/m$^2$), the current density ($I_t$) is changed to −316 (μA/m$^2$) (converted current value: −8(μA)) and −395 (μA/m$^2$) (converted current value: −10 (μA)), the surface potential measurement is performed in the same manner. The obtained result is shown in Table 1.

Very good: When an absolute value of the current density $I_t$ (μA/m$^2$) is 395, an absolute value of the transfer memory potential (V) assumes a value of 8 or less.

Good: When an absolute value of the current density $I_t$ (μA/m$^2$) is 316, an absolute value of the transfer memory potential (V) assumes a value of 8 or less.

Fair: When an absolute value of the current density $I_t$ (μA/m$^2$) is 237, an absolute value of the transfer memory potential (V) assumes a value of 8 or less.

Bad: In the above-mentioned surface potential measurement, an absolute value of the transfer memory potential (V) assumes a value of above 8.

Examples 2 to 10

In examples 2 to 10, except that the applied voltage which is applied to the conductive brush is changed to values ranging from 1900(V) to 1100(V), the electrophotographic photoconductors and the conductive members are formed under the substantially same condition as the example 1 and the transfer memory potential is evaluated. The obtained result is shown in Table 1.

Comparison Examples 1 to 6

In comparison examples 1 to 6, except that the applied voltage which is applied to the conductive brush is changed to values ranging from 1000(V) to 500(V), the electrophotographic photoconductors and the conductive members are formed under the substantially same condition as the example 1 and the transfer memory potential is evaluated. The obtained result is shown in Table 1.

Comparison Example 7

In comparison example 7, except that the conductive brush is grounded and set to 0(V), the electrophotographic photoconductor and the conductive member are formed under the substantially same condition as the example 1 and the transfer memory potential is evaluated. The obtained result is shown in Table 1.

TABLE 1

| | | $I_t$ = −237 (μA/m$^2$) | | $I_t$ = −316 (μA/m$^2$) | | $I_t$ = −395 (μA/m$^2$) | | |
|---|---|---|---|---|---|---|---|---|
| | brush applied voltage $V_b$ (V) | current density $I_b$ (μA/m$^2$) | transfer memory potential Vt (V) | current density $I_b$ (μA/m$^2$) | transfer memory potential Vt (V) | current density $I_b$ (μA/m$^2$) | transfer memory potential Vt (V) | evaluation result surface potential |
| Example 1 | 2000 | 2273 | −2 | 2367 | −3 | 2462 | −5 | very good |
| Example 2 | 1900 | 2102 | −3 | 2216 | −4 | 2311 | −5 | very good |
| Example 3 | 1800 | 1951 | −3 | 2064 | −6 | 2140 | −6 | very good |
| Example 4 | 1700 | 1780 | −3 | 1894 | −6 | 1977 | −7 | very good |
| Example 5 | 1600 | 1610 | −4 | 1723 | −7 | 1818 | −8 | very good |
| Example 6 | 1500 | 1439 | −4 | 1553 | −7 | 1629 | −9 | good |
| Example 7 | 1400 | 1250 | −6 | 1383 | −8 | 1477 | −10 | good |
| Example 8 | 1300 | 1080 | −6 | 1212 | −9 | 1288 | −11 | fair |
| Example 9 | 1200 | 890 | −7 | 1023 | −9 | 1117 | −13 | fair |
| Example 10 | 1100 | 720 | −8 | 833 | −12 | 928 | −15 | fair |
| Comparison example 1 | 1000 | 530 | −9 | 644 | −15 | 758 | −20 | bad |
| Comparison example 2 | 900 | 341 | −11 | 455 | −18 | 549 | −24 | bad |
| Comparison example 3 | 800 | 170 | −14 | 284 | −25 | 360 | −30 | bad |
| Comparison example 4 | 700 | 38 | −17 | 95 | −30 | 170 | −43 | bad |
| Comparison example 5 | 600 | 0 | −17 | 19 | −33 | 38 | −50 | bad |
| Comparison example 6 | 500 | 0 | −17 | 0 | −35 | 0 | −54 | bad |
| Comparison example 7 | 0 | 0 | −17 | 0 | −35 | 0 | −55 | bad |

As can be understood from the result shown in Table 1, in the examples 1 to 10, conditions which conform to the precharging means according to the present invention are used and hence, in the evaluation of charging property and image, it is possible to obtain the favorable result.

On the other hand, in the comparison examples 1 to 7, the current density ($I_b$) of the current which is injected into the photoconductor from the conductive member is insufficient and hence, the transfer memory remains on the surface of the photoconductor after the conductive member passes whereby defects are found in the image evaluation.

INDUSTRIAL APPLICABILITY

According to the image forming apparatus and the image forming method which uses the image forming apparatus according to the present invention, by erasing the generated transfer memory using the precharging means having the optimized conditions, even when the positively-charged single-layer-type electrophotographic photoconductor is used, the image forming apparatus and the image forming method can exhibit the excellent charge eliminating effect.

Accordingly, the image forming apparatus and the image forming method which uses the image forming apparatus of the present invention are expected to contribute to the improvement of image quality, the low power consumption and the miniaturization of the image forming apparatus.

What is claimed is:

1. An image forming apparatus which sequentially arranges a charging device, a developing device, a transfer device, and a charge eliminating device around a single-layer-type electrophotographic photoconductor, wherein the charging device charges a surface of the single-layer-type electrophotographic photoconductor with a positive polarity, a precharging device having a conductive member is arranged on an upstream side of the charge eliminating device, the conductive member is brought into contact with the surface of the single-layer-type electrophotographic photoconductor, and a current density $I_b$ ($\mu A/m^2$) of an injected current into the single-layer-type electrophotographic photoconductor from the conductive member is set to a value of 700($\mu A/m^2$) or more.

2. The image forming apparatus according to claim 1, wherein assuming the current density of the injected current into the single-layer-type electrophotographic photoconductor from the conductive member as $I_b$ ($\mu A/m^2$) and a current density of an injected current into the single-layer-type electrophotographic photoconductor from the transfer device as $I_t$ ($\mu A/m^2$), a value expressed by $|I_b/I_t|$ is set to a value of 2 or more.

3. The image forming apparatus according to claim 1, wherein assuming an absolute value of a current density $I_t$ ($\mu A/m^2$) of an injected current into the single-layer-type electrophotographic photoconductor from the transfer device as a value of 316 or more, an absolute value of a transfer memory potential (V) is set to a value of 8 or less.

4. The image forming apparatus according to claim 1, wherein an applied voltage to the conductive member is set to a value of 1100 (V) or more in a DC voltage.

5. The image forming apparatus according to claim 1, wherein the conductive member is formed of a brush-like conductive member.

6. The image forming apparatus according to claim 5, wherein a yarn resistance of a brush which constitutes the conductive member is set to a value of $1\times10^{10}$ ($\Omega\cdot$cm) or less.

7. The image forming apparatus according to claim 1, wherein the charging device is a contact-charge-type charging device.

8. The image forming apparatus according to claim 1, wherein an initial charge potential of the single-layer-type electrophotographic photoconductor by the charging device is set to a value of 400 (V) or more.

9. An image forming method which uses an image forming apparatus which sequentially arranges a charging device, a developing device, a transfer device, and a charge eliminating device around a single-layer-type electrophotographic photoconductor, wherein the single-layer-type electrophotographic photoconductor is charged with a positive polarity by the charging device, a precharging device having a conductive member is arranged on an upstream side of the charge eliminating device, and the conductive member is brought into contact with the surface of the single-layer-type electrophotographic photoconductor, and a current density $I_b$ ($\mu A/m^2$) of an injected current into the single-layer-type electrophotographic photoconductor from the conductive member is set to a value of 700 ($\mu A/m^2$) or more.

* * * * *